US005977696A

United States Patent [19]

Okamoto

[11] Patent Number: 5,977,696

[45] Date of Patent: Nov. 2, 1999

[54] FIELD EMISSION ELECTRON GUN CAPABLE OF MINIMIZING NONUNIFORM INFLUENCE OF SURROUNDING ELECTRIC POTENTIAL CONDITION ON ELECTRONS EMITTED FROM EMITTERS

[75] Inventor: Akihiko Okamoto, Tokyo, Japan

[73] Assignee: NEC Corporation, Tokyo, Japan

[21] Appl. No.: 08/848,463

[22] Filed: May 8, 1997

[30] Foreign Application Priority Data

May 9, 1996 [JP] Japan ..... 8-115040

[51] Int. Cl.[6] ..... H01J 1/02

[52] U.S. Cl. ..... 313/309; 313/308; 313/307; 313/336; 313/351

[58] Field of Search ..... 313/309, 336, 313/308, 497, 351; 315/169.4, 325, 349, 341

[56] References Cited

U.S. PATENT DOCUMENTS 4,578,614 3/1986 Gray et al. ..... 313/336 X
5,191,217 3/1993 Kane et al. ..... 250/423
5,430,347 7/1995 Kane et al. ..... 313/309

FOREIGN PATENT DOCUMENTS 5-242794 9/1993 Japan .
5-266806 10/1993 Japan .
5-343000 12/1993 Japan .
7-29484 1/1995 Japan .

*Primary Examiner*—Ashok Patel
*Attorney, Agent, or Firm*—Foley & Lardner

[57] ABSTRACT

In a field emission electron gun including emitters (104) on predetermined parts of a substrate (109), an insulator film (105) on a remaining part of the substrate, a first gate electrode (101) on the insulator film so as to surround the emitters with a space left between each emitter and the first gate electrode and to have an outer peripheral surface defining an emission region (E), a gate edge portion (106) of a conductor is formed on the insulator film to surround the outer peripheral surface of the first gate electrode in contact with the outer peripheral surface of the first gate electrode. A second gate electrode (102) is formed on the insulator film to surround the gate edge portion with a distance left between the gate edge portion and the second gate electrode applied with a second voltage less than a first voltage applied to the first gate electrode.

15 Claims, 6 Drawing Sheets

FIELD EMISSION ELECTRON GUN CAPABLE OF MINIMIZING NONUNIFORM INFLUENCE OF SURROUNDING ELECTRIC POTENTIAL CONDITION ON ELECTRONS EMITTED FROM EMITTERS

BACKGROUND OF THE INVENTION

This invention relates to a field emission electron gun including a plurality of sharp-pointed emitters.

A field emission electron gun includes an emitter for emitting electrons and an anode electrode. The emitter is of a sharp pointed shape for concentrating an electric field. In general, a plurality of emitters are integrated in order to increase a total current of the field emission electron gun. The field emission electron gun further includes a first gate electrode surrounding the emitter with a space left therebetween and having an outer peripheral surface defining an emission region. A second gate electrode surrounds the outer peripheral surface of the first gate electrode with a distance left therebetween.

The field emission electron gun is employed for a wide range of applications. If the field emission electron gun is used in a planar display device, a fluorescent member is located at a distance on the order of 1 mm from the electron gun. Electrons are emitted from the emitters of the emission region as an electron beam towards the fluorescent member.

Naturally, the electron beam is emitted with a particular diverging angle. If the diverging angle is large, the electron beam can not form a sufficiently small diameter or cross-sectional area on the fluorescent member. This decreases the luminance of the fluorescent member.

Empirically, it has been confirmed that the diverging angle ranges between 20 and 30 degrees. In order to assure a sufficient luminance, various proposals have been made to suppress the diverging angle. For example, Japanese Unexamined Patent Publications (JP-A) Nos. 343000/1993, 242794/1993, 266806/1993, and 29484/1995 disclose the use of a deflection electrode or a focusing electrode to cause repulsion of electrons so as to suppress the divergence of the electron beam.

As will later be described, a conventional field emission electron gun is incapable of minimizing nonuniform influence of a surrounding electric potential condition on electrons emitted from emitters of the emission region.

SUMMARY OF THE INVENTION

It is therefore an object of this invention to provide a field emission electron gun capable of minimizing nonuniform influence of a surrounding electric potential condition on electrons emitted from emitters of an emission region.

It is another object of this invention to provide a field emission electron gun of the type described, which is capable of achieving a uniform electron emission characteristic in common to the emitters of the emission region.

Other objects of this invention will become clear as the description proceeds.

According to a first aspect of this invention, there is provided a field emission electron gun comprising: a substrate of a conductive material; a plurality of emitters, each of which is of a sharp pointed shape and which are formed on a plurality of predetermined parts of the substrate for emitting electrons; an insulator film formed on a remaining part of the substrate; a first gate electrode formed on the insulator film so as to surround the emitters with a space left between each of the emitters and the first gate electrode and to have an outer peripheral surface defining an emission region, the first gate electrode being supplied with a first voltage; a gate edge portion of a conductor formed on the insulator film to surround the outer peripheral surface of the first gate electrode in contact with the outer peripheral surface of the first gate electrode; and a second gate electrode formed on the insulator film to surround the gate edge portion with a distance left between the gate edge portion and the second gate electrode. The second gate electrode is applied with a second voltage less than the first voltage. A ratio of a width of the gate edge portion to the distance falls between 0.5 and 1.5, both inclusive.

According to a second aspect of this invention, there is provided a field emission electron gun comprising: a substrate of a conductive material; a plurality of emitters, each of which is of a sharp pointed shape and which are formed on a plurality of predetermined parts of the substrate for emitting electrons; an insulator film formed on a remaining part of the substrate; a first gate electrode formed on the insulator film so as to surround the emitters with a space left between each of the emitters and the first gate electrode and to have an outer peripheral surface defining an emission region, the first gate electrode being supplied with a first voltage; a gate edge portion of a conductor formed on the insulator film to surround the outer peripheral surface of the first gate electrode in contact with the outer peripheral surface of the first gate electrode; and a second gate electrode formed on the insulator film to surround the gate edge portion with a distance left between the gate edge portion and the second gate electrode. The second gate electrode is applied with a second voltage less than the first voltage. A ratio of an average of a width of the gate edge portion to another average of the distance falls between 0.5 and 1.5, both inclusive.

According to a third aspect of this invention, there is provided a field emission electron gun comprising: a substrate of a conductive material; a plurality of emitters, each of which is of a sharp pointed shape and which are formed on a plurality of predetermined parts of the substrate for emitting electrons; an insulator film formed on a remaining part of the substrate; a first gate electrode formed on the insulator film so as to surround the emitters with a space left between each of the emitters and the first gate electrode and to have an outer peripheral surface defining an emission region, the first gate electrode being supplied with a first voltage; a gate edge portion of a conductor formed on the insulator film to surround the outer peripheral surface of the first gate electrode in contact with the outer peripheral surface of the first gate electrode; and a second gate electrode formed on the insulator film to surround the gate edge portion with a distance left between the gate edge portion and the second gate electrode. The second gate electrode is applied with a second voltage less than the first voltage. The gate edge portion has a plurality of holes exposing the insulator film.

According to a fourth aspect of this invention, there is provided a field emission electron gun comprising: a substrate of a conductive material; a plurality of emitters, each of which is of a sharp pointed shape and which are formed on a plurality of predetermined parts of the substrate for emitting electrons; an insulator film formed on a remaining part of the substrate; a first gate electrode formed on the insulator film so as to surround the emitters with a space left between each of the emitters and the first gate electrode and to have an outer peripheral surface defining an emission region, the first gate electrode being supplied with a first voltage; a gate edge portion of a conductor formed on the insulator film to surround the outer peripheral surface of the first gate electrode in contact with the outer peripheral surface of the first gate electrode; and a second gate electrode formed on the insulator film to surround the gate edge portion with a distance left between the gate edge portion and the second gate electrode. The second gate electrode is applied with a second voltage less than the first voltage. The gate edge portion has a plurality of grooves.

By appropriately selecting the ratio of the width of the gate edge portion to the distance, the ratio of the average of the width of the gate edge portion to the average of the distance, a combination of the number of the holes of the gate edge portion and the size of each of the holes, or another combination of the number of the grooves of the gate edge portion and the size of each of the grooves, it is possible to minimize nonuniform influence of a surrounding electric potential condition on electrons emitted from the emitters of the emission region and to control so that emission characteristics of the individual electrons become uniform.

DESCRIPTION OF THE PREFERRED EMBODIMENTS

Figure 1:
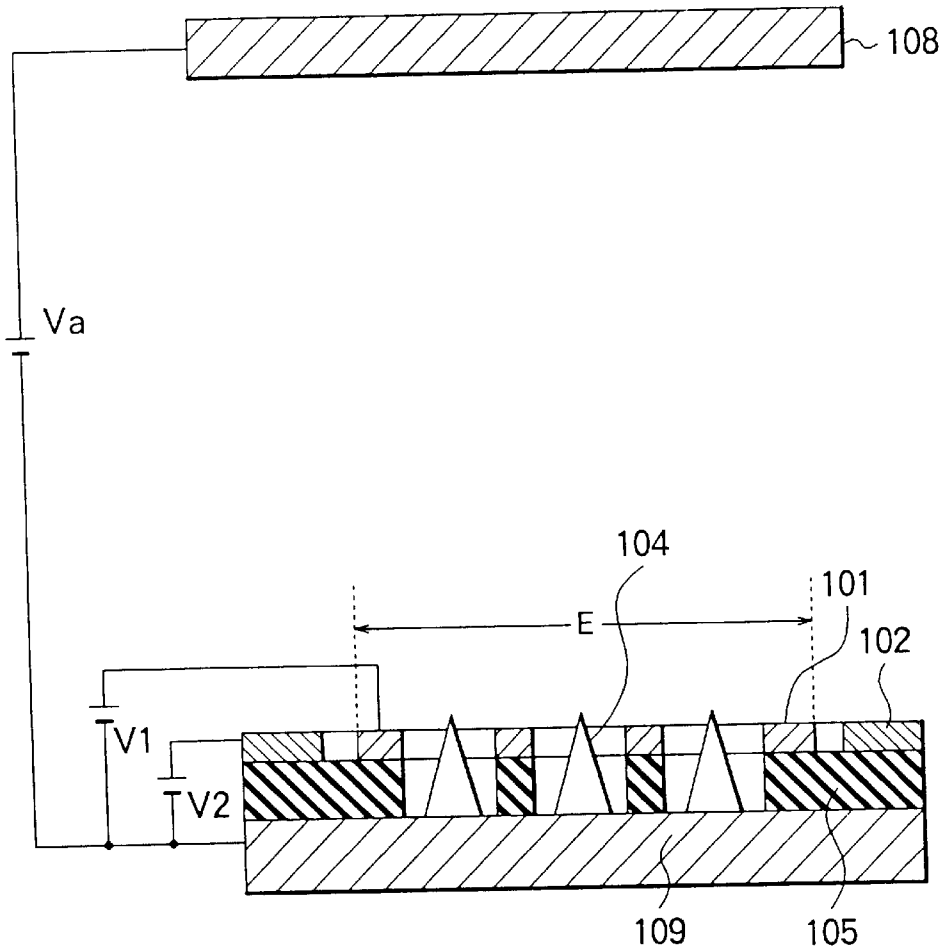
FIG. 1 PRIOR ART
FIG. 1 is a sectional view of a conventional field emission electron gun.

Referring to FIG. 1, a conventional field emission electron gun will first be described for a better understanding of this invention. The field emission electron gun is equivalent to the conventional field emission electron gun described in the preamble of the instant specification and has a double gate structure.

The field emission electron gun includes a substrate 109 of a conductive material of, for example, silicon (Si). The conductive material may be either a different semiconductor or a conductor. A plurality of emitters 104, each of which is of a sharp-pointed cone shape, are formed on a plurality of predetermined parts of the substrate 109 for emitting electrons. An insulator film 105 is formed on a remaining part of the substrate 109.

A first gate electrode (or an extracting electrode) 101 of a metal film is formed on the insulator film 105 so as to surround the emitters 104 with a space left between each of the emitters 104 and the first gate electrode 101 and to have an outer peripheral surface defining an emission region E. The first gate electrode 101 is applied with a first voltage V1.

A second gate electrode (or a focusing electrode) 102 of a metal film is formed on the insulator film 105 to surround the outer peripheral surface of the first gate electrode 101 with a distance (or a gap) left between the outer peripheral surface of the first gate electrode 101 and the second gate electrode 102. The second electrode 102 is applied with a second voltage V2. The second voltage V2 is less than the first voltage V1.

An anode electrode 108 is arranged above the first and the second gate electrodes 101 and 102. The anode electrode 102 is applied with a different voltage Va.

A first power supply of the first voltage V1 is connected between the substrate 109 and the first gate electrode 101. A second power supply of the second voltage V2 is connected between the substrate 109 and the second gate electrode 102. Inasmuch as a voltage drop in the substrate 109 is substantially negligible, it is understood that the first voltage V1 is applied between the emitters 104 and the first gate electrode 101 and that the second voltage V2 is applied between the emitters 104 and the second gate electrode 102. A different power supply of the voltage Va is connected between the substrate 109 and the anode electrode 108.

Electrons emitted from the tip of each emitter 104 are deflected by the second gate electrode 102. After passing through the first gate electrode 101, the electrons are accelerated by an anode potential of the anode electrode 108. Finally, the electrons are focused on the anode electrode 108 as an electron beam.

In the above-described field emission electron gun, the electrons emitted from the tip of each emitter 104 are deflected by the second gate electrode 102 having an electric potential lower than the first voltage V1 of the first gate electrode 101. Since a plurality of the emitters 104 are surrounded by the single second gate electrode 102, a dispositional relationship between each individual emitter 104 and the second gate electrode 102 is different in dependence upon the location of each individual emitter 104. The emitters 104 are arranged within the emission region E which is defined by the outer peripheral surface of the first gate electrode 101. The emitters 104 located in a central part and a peripheral part of the emission region E will be referred to as inner emitters and outer emitters, respectively. The influence by the second gate electrode 102 is greatly different between the electrons emitted from the inner emitters 104 and those emitted from the outer emitters 104. Specifically, the electrons emitted from the outer emitters 104 nearer to the second gate electrode 102 are under a greater influence from the second gate electrode 102.

The first and the second gate electrodes 101 and 102 must be electrically isolated. To this end, the first and the second gate electrodes 101 and 102 are spatially separated from each other to form a gap therebetween, as illustrated in FIG. 1. Through the gap, the electrons are affected by an electric potential of the substrate 109.

Particularly, in the peripheral part of the emission region E, the electrons are affected by electric potentials of the inner emitters 104 arranged in the central part. On the other hand, the outer peripheral surface of the first gate electrode 101 is present in the peripheral part of the emission region E. In addition, the gap between the first and the second gate electrodes 101 and 102 is present in an outer side of the outer peripheral surface of the first gate electrode 101. The second gate electrode 102 is located outside of the gap.

With the above-mentioned structure, the electrons are subjected to internal repulsion from the inner emitters 104 kept at the electric potential lower than that of the first gate electrode 101. In addition, the electrons are subjected to external repulsion from the gap having an electric potential lower than that of the first gate electrode 101. It is noted here that the repulsion to which the electrons are subjected from the gap, is dependent upon a distance from the outer peripheral surface of the first gate electrode 101. If the distance is great, the influence of the repulsion will be small.

Thus, the field emission electron gun is inevitably subjected to nonuniform influence of a surrounding electric potential condition on the electrons emitted from the emitters 104 arranged in the emission region E.

This invention provides a field emission electron gun which is capable of minimizing an influence of the surrounding electric potential condition on the electrons emitted from the outer emitters arranged in the peripheral part of the emission region E so that an electron emission characteristic of the outer emitters is controlled to be similar to that of the inner emitters arranged in the central part of the emission region E.

Figure 2:
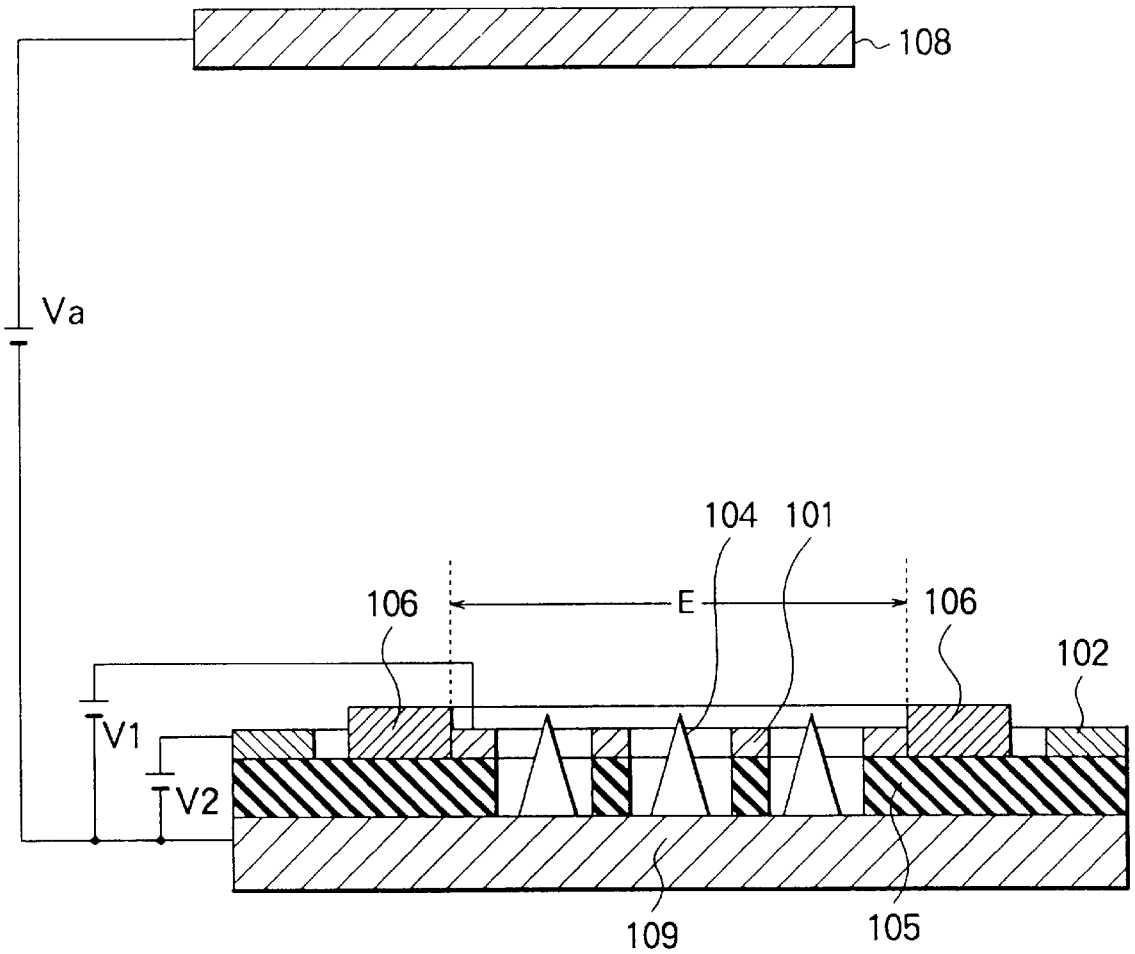
FIG. 2 is a sectional view of a field emission electron gun according to a first embodiment of this invention.
Figure 3:
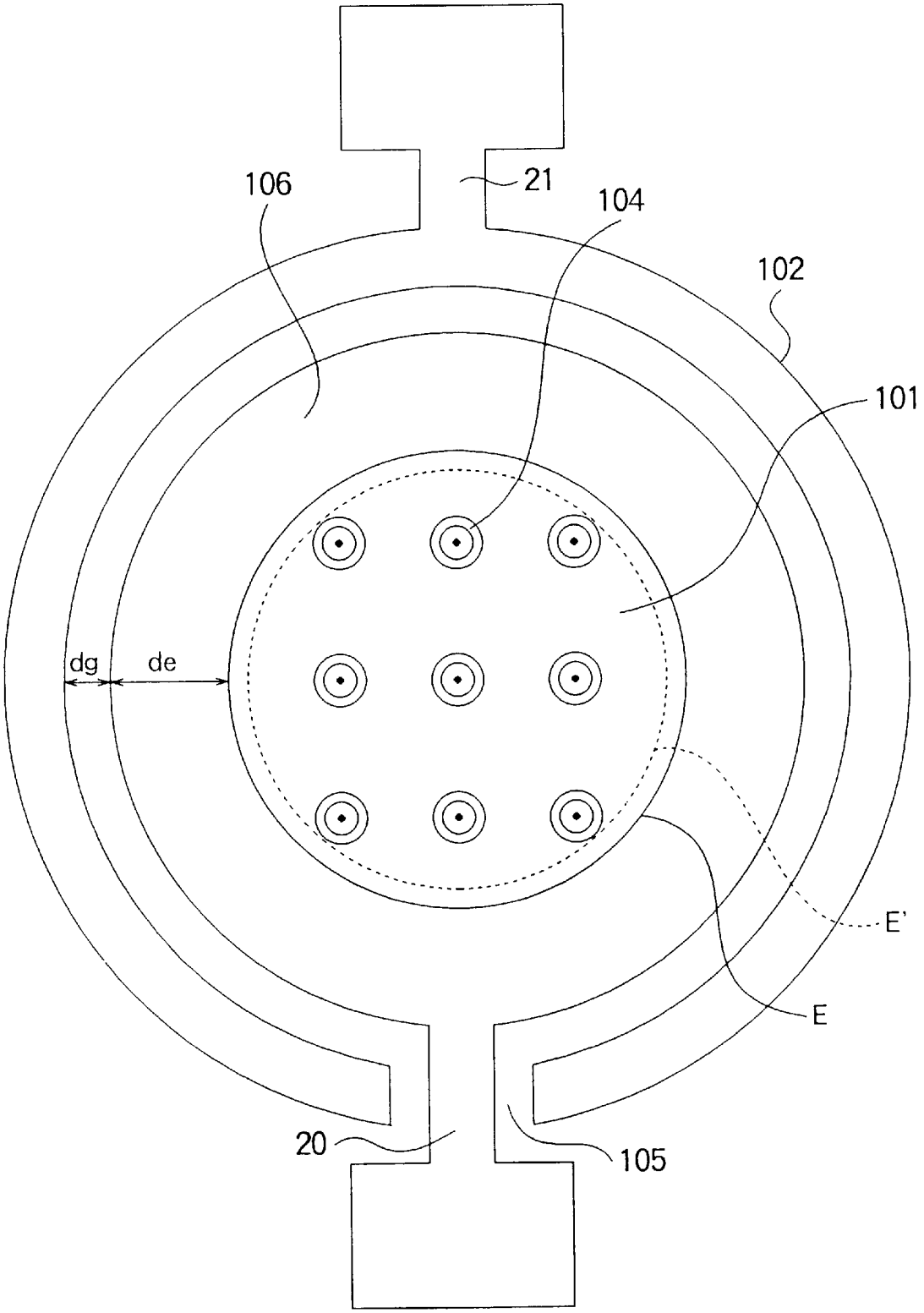
FIG. 3 is a plan view of the field emission electron gun illustrated in FIG. 2.

Turning to FIGS. 2 and 3, illustration is made of a field emission electron gun according to a first embodiment of this invention.

In FIGS. 2 and 3, the field emission electron gun is similar to the field emission electron gun of FIG. 1 except for the following. That is, a gate edge portion 106 of a metal film is formed on the insulator film 109 to surround the outer peripheral surface of the first gate electrode 101 in contact with the outer peripheral surface of the first gate electrode 101. The gate edge portion 106 has a width which is illustrated in FIG. 3 by a reference sign de. The second gate electrode 102 is formed on the insulator film 109 to surround the gate edge portion 106 with a distance (or a gap) left between the gate edge portion 106 and the second gate electrode 102. The distance is designated in FIG. 3 by a reference sign dg. A ratio of the width de of the gate edge portion 106 to the distance dg falls between 0.5 and 1.5, both inclusive.

In FIG. 3, the outer peripheral surface of the first gate electrode 101 forms a circular cylindrical surface to define the emission region E of a circular shape. The gate edge portion 106 is of a circular ring shape and is connected to a lead line 20 which is applied with the first voltage V1 (FIG. 2) and supply the first voltage V1 to the first gate electrode 101. The second gate electrode 102 is of another circular ring shape and is connected to another lead line 21 which is applied with the second voltage V2 (FIG. 2).

Figure 4:
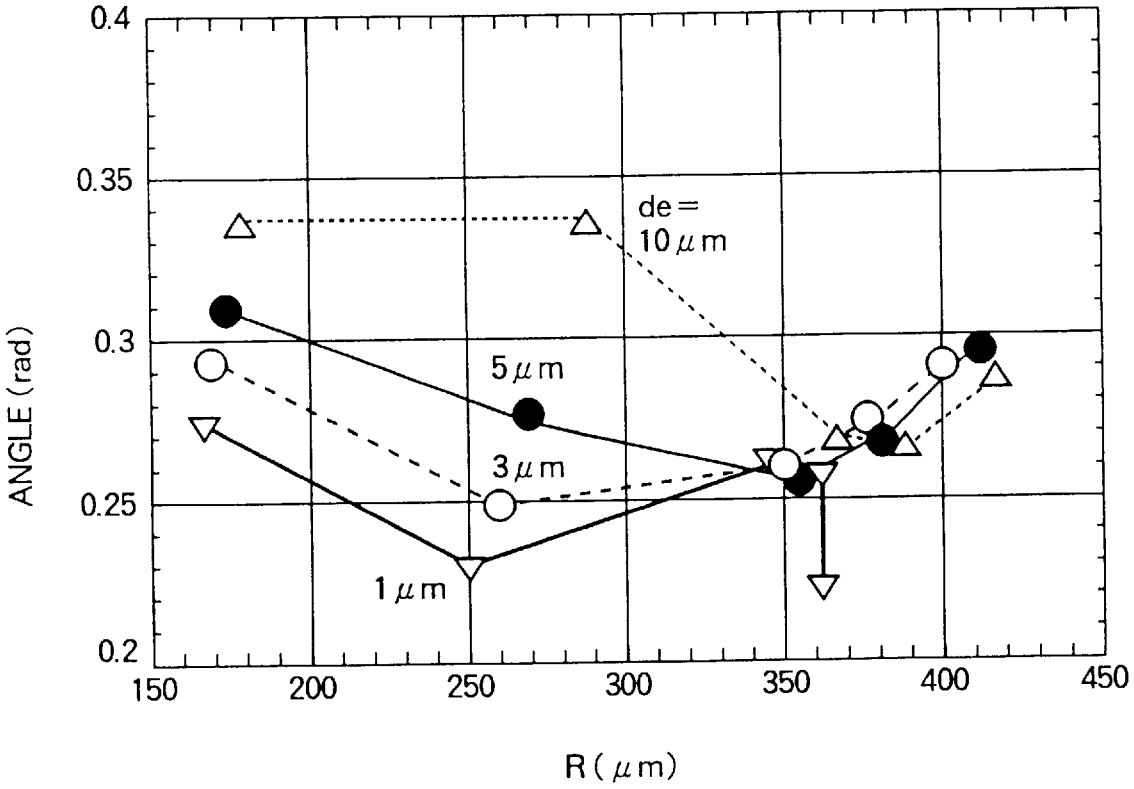
FIG. 4 is a graph showing, in a topological space, a simulation result of the field emission electron gun illustrated in FIGS. 2 and 3.

Turning to FIG. 4, description will proceed to a simulation result of the field emission electron gun illustrated in FIGS. 2 and 3. The simulation result shown in FIG. 4 is obtained in the field emission electron gun of FIG. 3 under the following condition.

That is, the emission region E defined by the outer peripheral surface of the first gate electrode 101 has a diameter of 50 μm. The emission region E includes at least the emitters 104 which are located at the distances of 0 μm, 10 μm, 20 μm, 22 μm, and 24 μm from a center of the emission region E. The emitters 104, which are located at the distances of 24 μm from the center of the emission region E, are farthest from the center of the emission region E among all of the emitters 104. The first gate electrode 101 has gate holes, each having a diameter of 1.2 μm. Herein, each gate hole is formed in the first gate electrode 101 to allow protrusion of each emitter 104. Inasmuch as the emitters 104 located at the distances of 24 μm from the center of the emission region E, are farthest from the center of the emission region E and as each gate hole having a diameter of 1.2 μm, a difference between an outer periphery of the emission region E and another outer periphery of a primary emission region illustrated in FIG. 3 by a sign E' is 0.4 μm. The distance dg of a gap between the gate edge portion 106 and the second gate electrode 102 is equal to 5 μm. The width de of the gate edge portion 106 is varied between 1 and 10 μm. The first and the second voltages V1 and V2 applied to the first and the second gate electrodes 101 and 102 are equal to 70V and 50V, respectively. The voltage Va applied to the anode electrode 108 is equal to 70V.

In FIG. 4, a topological space is illustrated for comparison of electron emission characteristics under different conditions in which the gate edge portion 106 has a width of 10 μm (depicted by Δ), 5 μm (depicted by ●), 3 μm (depicted by ○), and 1 μm (depicted by ▽), respectively. In each condition, the electrons are emitted from the emitters 104 located at the distances of 0 μm, 10 μm, 20 μm, 22 μm, and 24 μm from the center of the emission region E with an initial diverging angle of 20 degrees. In the figure, an abscissa represents positions of the electrons in a plane apart from an upper surface of the first gate electrode 101 by a distance of 500 μm. In the abscissa, R (μm) represents a distance from a center of the plane that is defined by a center axis of the first gate electrode 101. On the other hand, an ordinate represents diverging angles (rad.) of the electrons within the plane. When the gate edge portion 106 has a width as wide as 10 μm, the electrons emitted from the emitters 104 located at the distances of 0 μm and 10 μm have a much greater diverging angle than those emitted from the emitters 104 located at the periphery, namely, at the distances of 20 μm, 22 μm, and 24 μm. On the other hand, when the gate edge portion 106 has a width as narrow as 1 μm, the electrons emitted from the emitters 104 at the periphery are affected by the gap in the neighborhood to have an emission direction excessively biased towards the center of the plane. As described above, if the gate edge portion 106 has the width de of 10 μm or 1 μm, a flat display using the field emission electron gun can not achieve excellent current convergence on a fluorescent member arranged at a distance between 0.5 mm (500 μm) and 2 mm from the upper surface of the first gate electrode 101. On the other hand, if the width de of the gate edge portion 106 is selected between 2.5 and 7.5 μm, excellent current convergence can be achieved as seen from FIG. 4. Specifically, the excellent current convergence is achieved if the following relationship is satisfied:

$$(1/2)\times dg \leqq de \leqq (3/2)\times dg,$$

where dg represents the distance between the gate edge portion 106 and the second gate electrode 102, de representing the width of the gate edge portion 106.

The field emission electron gun of FIG. 3 is described above, in which the outer peripheral surface of the first gate electrode 101 forms a circular cylindrical surface to define the emission region E of a circular shape and which each of the gate edge portion 106 and the second gate electrode 102 is of a circular ring shape. However, this invention is not restricted to the above-described structure of FIG. 3 and may have various other structures.

For example, it may be that the outer peripheral surface of the first gate electrode 101 forms an elliptical cylindrical surface to define the emission region E of an elliptical shape and that each of the gate edge portion 106 and the second gate electrode 102 is of an elliptical ring shape. In this case, a ratio of an average of the width of the gate edge portion 106 to another average of the distance between the gate edge portion 106 and the second gate electrode 102 is selected between 0.5 and 1.5, both inclusive.

Figure 5:
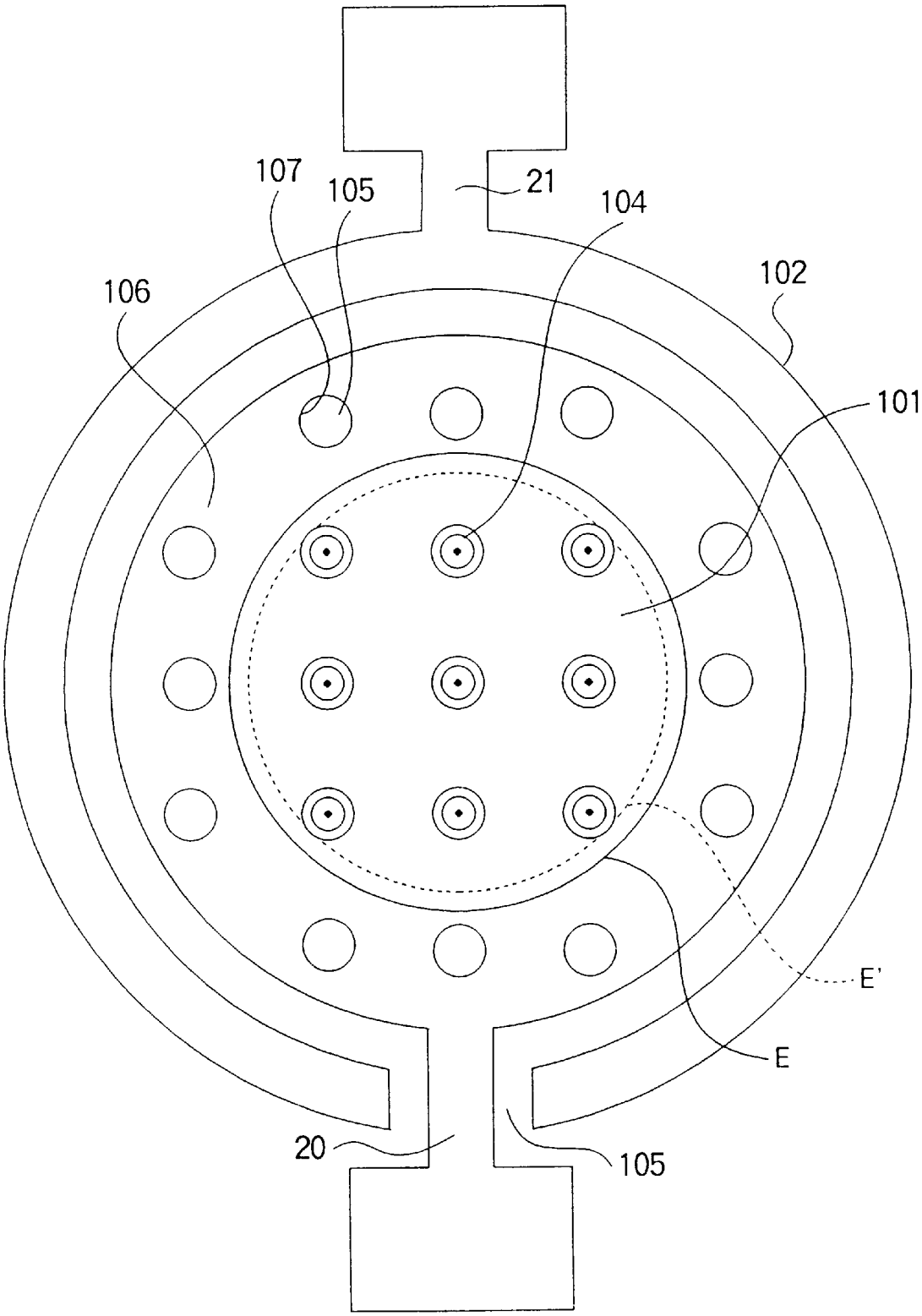
FIG. 5 is a plan view of a field emission electron gun according to a second embodiment of this invention.

Turning to FIG. 5, a field emission electron gun according to a second embodiment of this invention is similar to the field emission electron gun of FIGS. 2 and 3 except that the gate edge portion 106 has a plurality of holes 107 exposing the insulator film 105 and that the number of the holes 107 and the size of each of the holes 107 are appropriately selected of appropriate selection, of the ratio of the width of the gate edge portion 106 to the distance between the gate edge portion 106 and the second gate electrode 102.

In the first embodiment, the width of the gate edge portion 106 is specified to control the electron emission direction of the field emission electron gun as a whole. On the other hand, in the second embodiment, the holes 107 are formed in the gate edge portion 106 to achieve a uniformity in electron emission direction of the individual emitters 104 located at different positions. Specifically, in the field emission electron gun according to the second embodiment, the electric potential of the substrate 109 affects the gate edge portion 106 through the holes 107 formed therein to lower the electric potential of the gate edge portion 106.

In FIG. 5, the holes 107 formed in the gate edge portion 106 have a circular shape. However, the holes 107 may have a different shape other than the circular shape, such as a rectangular shape.

Figure 6:
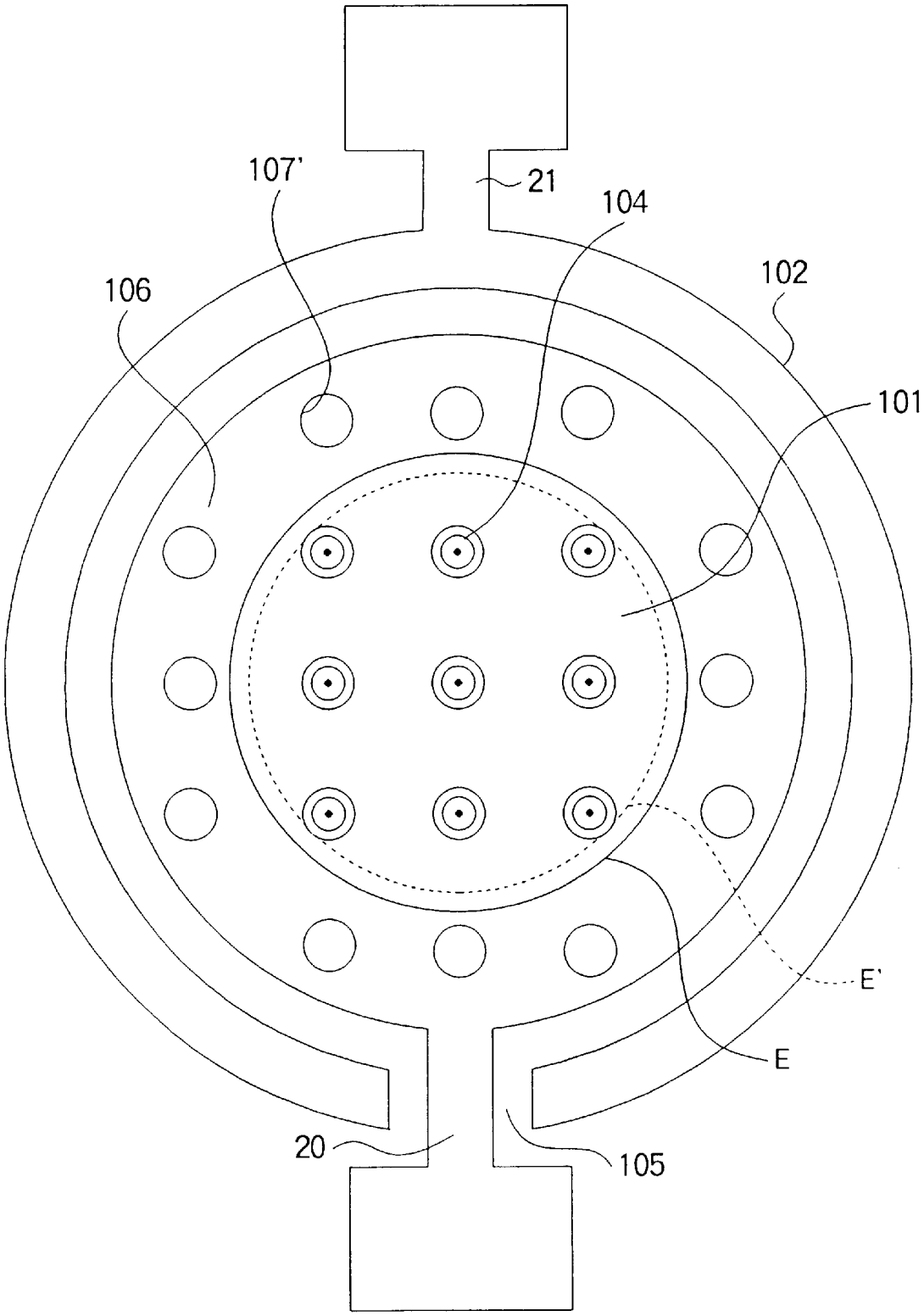
FIG. 6 is a plan view of a field emission electron gun according to a third embodiment of this invention.

Turning to FIG. 6, a field emission electron gun according to a third embodiment of this invention is similar to the field emission electron gun of FIG. 5 except that the gate edge portion 106 has a plurality of grooves 107' instead of a plurality of the holes 107 (FIG. 5) and that the number of the grooves 107' and the size of each of the grooves 107' are appropriately selected In FIG. 6, the grooves 107' formed in the gate edge portion 106 have a circular shape. However, the grooves 107' may have a different shape other than the circular shape, such as a rectangular shape.

As described above, the field emission electron gun according to this invention comprises a gate edge portion of a conductor formed on an insulator film to surround a first gate electrode in contact with an outer peripheral surface of the first gate electrode and a second gate electrode formed on the insulator film to surround the gate edge portion with the distance kept therefrom. The ratio of the width of the gate edge portion to the above-mentioned distance or the structure of the gate edge portion is determined so as to minimize the influence of a surrounding electric potential condition upon electrons emitted from outer emitters arranged in a peripheral part. Thus, an electron emission characteristic of the outer emitters is controlled to be similar to that of inner emitters arranged in a central part.

That is, in the field emission electron gun according to this invention, the gate edge portion serves to achieve the uniformity in electron emission direction between the emitters located apart from the center of the emission region and those located at the center of the emission region. In the conventional field emission electron gun, a high-density current can not be obtained because the electrons emitted from the individual emitters have a wide diverging angle so that the emission direction is different in dependence upon the location of each individual emitter. On the other hand, in this invention, a sufficient convergence is achieved even if the emission region is relatively large. Therefore, the emission region can be increased in area so that a large electric current is obtained.

What is claimed is:

1. A field emission electron gun comprising:

a substrate of a conductive material;

a plurality of emitters, each of which is of a sharp pointed shape and which are formed on a plurality of predetermined parts of said substrate for emitting electrons;

an insulator film formed on a remaining part of said substrate;

a first gate electrode formed on said insulator film so as to surround said emitters with a space left between each of said emitters and said first gate electrode and to have an outer peripheral surface defining an emission region, said first gate electrode being supplied with a first voltage;

a gate edge portion of a conductor formed on said insulator film to surround said outer peripheral surface of the first gate electrode in contact with said outer peripheral surface of the first gate electrode; and a second gate electrode formed on said insulator film to surround said gate edge portion with a distance left between said gate edge portion and said second gate electrode, said second gate electrode being applied with a second voltage less than said first voltage;

a ratio of a width of said gate edge portion to said distance falling between 0.5 and 1.5, both inclusive.

2. A field emission electron gun as claimed in claim 1, wherein the conductive material of said substrate is a conductor.

3. A field emission electron gun as claimed in claim 1, wherein the conductive material of said substrate is a semiconductor.

4. A field emission electron gun as claimed in claim 1, wherein:

said outer peripheral surface of the first gate electrode forms a circular cylindrical surface;

said gate edge portion being of a circular ring shape;

said second gate electrode being of another circular ring shape.

5. A field emission electron gun comprising:

a substrate of a conductive material;

a plurality of emitters, each of which is of a sharp pointed shape and which are formed on a plurality of predetermined parts of said substrate for emitting electrons;

an insulator film formed on a remaining part of said substrate;

a first gate electrode formed on said insulator film so as to surround said emitters with a space left between each of said emitters and said first gate electrode and to have an outer peripheral surface defining an emission region, said first gate electrode being supplied with a first voltage;

a gate edge portion of a conductor formed on said insulator film to surround said outer peripheral surface of the first gate electrode in contact with said outer peripheral surface of the first gate electrode; and a second gate electrode formed on said insulator film to surround said gate edge portion with a distance left between said gate edge portion and said second gate electrode, said second gate electrode being applied with a second voltage less than said first voltage;

a ratio of an average of a width of said gate edge portion to another average of said distance falling between 0.5 and 1.5, both inclusive.

6. A field emission electron gun as claimed in claim 5, wherein the conductive material of said substrate is a conductor.

7. A field emission electron gun as claimed in claim 5, wherein the conductive material of said substrate is a semiconductor.

8. A field emission electron gun comprising:

a substrate of a conductive material;

a plurality of emitters, each of which is of a sharp pointed shape and which are formed on a plurality of predetermined parts of said substrate for emitting electrons;

an insulator film formed on a remaining part of said substrate;

a first gate electrode formed on said insulator film so as to surround said emitters with a space left between each of said emitters and said first gate electrode and to have an outer peripheral surface defining an emission region, said first gate electrode being supplied with a first voltage;

a gate edge portion of a conductor formed on said insulator film to surround said outer peripheral surface of the first gate electrode in contact with said outer peripheral surface of the first gate electrode; and a second gate electrode formed on said insulator film to surround said gate edge portion with a distance left between said gate edge portion and said second gate electrode, said second gate electrode being applied with a second voltage less than said first voltage;

said gate edge portion having a plurality of holes exposing said insulator film.

9. A field emission electron gun as claimed in claim 8, wherein the conductive material of said substrate is a conductor.

10. A field emission electron gun as claimed in claim 8, wherein the conductive material of said substrate is a semiconductor.

11. A field emission electron gun as claimed in claim 8, wherein:

said outer peripheral surface of the first gate electrode forms a circular cylindrical surface;

said gate edge portion being of a circular ring shape;

said second gate electrode being of another circular ring shape.

12. A field emission electron gun comprising:

a substrate of a conductive material;

a plurality of emitters, each of which is of a sharp pointed shape and which are formed on a plurality of predetermined parts of said substrate for emitting electrons;

an insulator film formed on a remaining part of said substrate;

a first gate electrode formed on said insulator film so as to surround said emitters with a space left between each of said emitters and said first gate electrode and to have an outer peripheral surface defining an emission region, said first gate electrode being supplied with a first voltage;

a gate edge portion of a conductor formed on said insulator film to surround said outer peripheral surface of the first gate electrode in contact with said outer peripheral surface of the first gate electrode; and a second gate electrode formed on said insulator film to surround said gate edge portion with a distance left between said gate edge portion and said second gate electrode, said second gate electrode being applied with a second voltage less than said first voltage;

said gate edge portion having a plurality of grooves, wherein a thickness of said gate edge portion in said plurality of grooves is greater than zero but less than X, where X is a thickness of said gate edge portion in regions other than said plurality of grooves.

13. A field emission electron gun as claimed in claim 12, wherein the conductive material of said substrate is a conductor.

14. A field emission electron gun as claimed in claim 12, wherein the conductive material of said substrate is a semiconductor.

15. A field emission electron gun as claimed in claim 12, wherein:

said outer peripheral surface of the first gate electrode forms a circular cylindrical surface;

said gate edge portion being of a circular ring shape;

said second gate electrode being of another circular ring shape.

* * * * *